United States Patent [19]

Scott

[11] 4,045,656

[45] Aug. 30, 1977

[54] TAXIMETERS

[76] Inventor: Keith Scott, Auckland, New Zealand

[21] Appl. No.: 664,253

[22] Filed: Mar. 5, 1976

[51] Int. Cl.[2] ..... G07B 13/00

[52] U.S. Cl. ..... 235/92 TC; 235/92 DM; 235/92 R; 235/30 R

[58] Field of Search ..... 235/92 TC, 92 DE, 92 DM, 235/92 CP, 92 PL, 30 R

[56] References Cited

U.S. PATENT DOCUMENTS

| | | | |
|---|---|---|---|
| 3,388,859 | 6/1968 | Kelch et al. | 235/30 R |
| 3,843,874 | 10/1974 | Kelch | 235/92 TC |
| 3,880,350 | 4/1975 | Iwatani et al. | 235/92 TC |
| 3,970,827 | 7/1976 | Ikuta et al. | 235/92 TC |

*Primary Examiner*—Joseph M. Thesz
*Attorney, Agent, or Firm*—Holman & Stern

[57] ABSTRACT

Disclosed is a taximeter for calculating a taxi fare based upon predetermined distance and time factors. An oscillator produces a time base pulse train and a transducer produces a distance pulse train. A modifier is controlled by the distance pulse train and modifies the time base pulse train when the distance pulse train exceeds a predetermined level. A counting device adds the modified time base pulse trains and provides a signal to a display device for indicating the taxi fare.

4 Claims, 2 Drawing Figures

FIG 1

TAXIMETERS

BACKGROUND OF THE INVENTION

This invention relates to taximeters.

In the past taximeters have been provided incorporating mechanical linkages and gear trains to provide a visual representation of a fare for a taxi hireage proportional to some predetermined combination of the distance travelled and the time taken. Such taximeters are subject to the normal limitations of wear and servicing requirements of mechanical appliances, and also involve considerable difficulty and expense to change the apparatus when changes are made in taxi hireage tariffs, which changes are at present frequently required.

SUMMARY OF THE INVENTION

It is therefore an object of the present invention to provide a taximeter which will obviate or minimise the foregoing disadvantages in a simple yet effective manner or which will at least provide the public with a useful choice.

Accordingly the invention consists in a taximeter for calculating a fare total from a predetermined combination of charges based on distance and/or time factors, said taximeter comprising an electronic circuit and associated components including an oscillator adapted to produce said time factor in the form of a constant frequency first electrical pulse train, a transducer adapted to produce said distance factor in the form of a second electrical pulse train, the frequency of which is proportional to the speed of the taxi, modifying means whereby said first pulse train is modified or controlled by said second pulse train so that the frequency of said first pulse train is modified or controlled to conform to the frequency of said second pulse train when the frequency of said second pulse train exceeds a predetermined limit, activation means adapted on operation to activate the taximeter, counting means for counting directly or indirectly the sum of pulses from said first pulse train when said taximeter is activated and display means adapted to display the fare resulting from the sum of the pulses counted by said counting means in a convenient form.

BRIEF DESCRIPTION OF THE DRAWINGS

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

The invention consists in the foregoing and also envisages constructions of which the following gives examples only.

Figure 1:
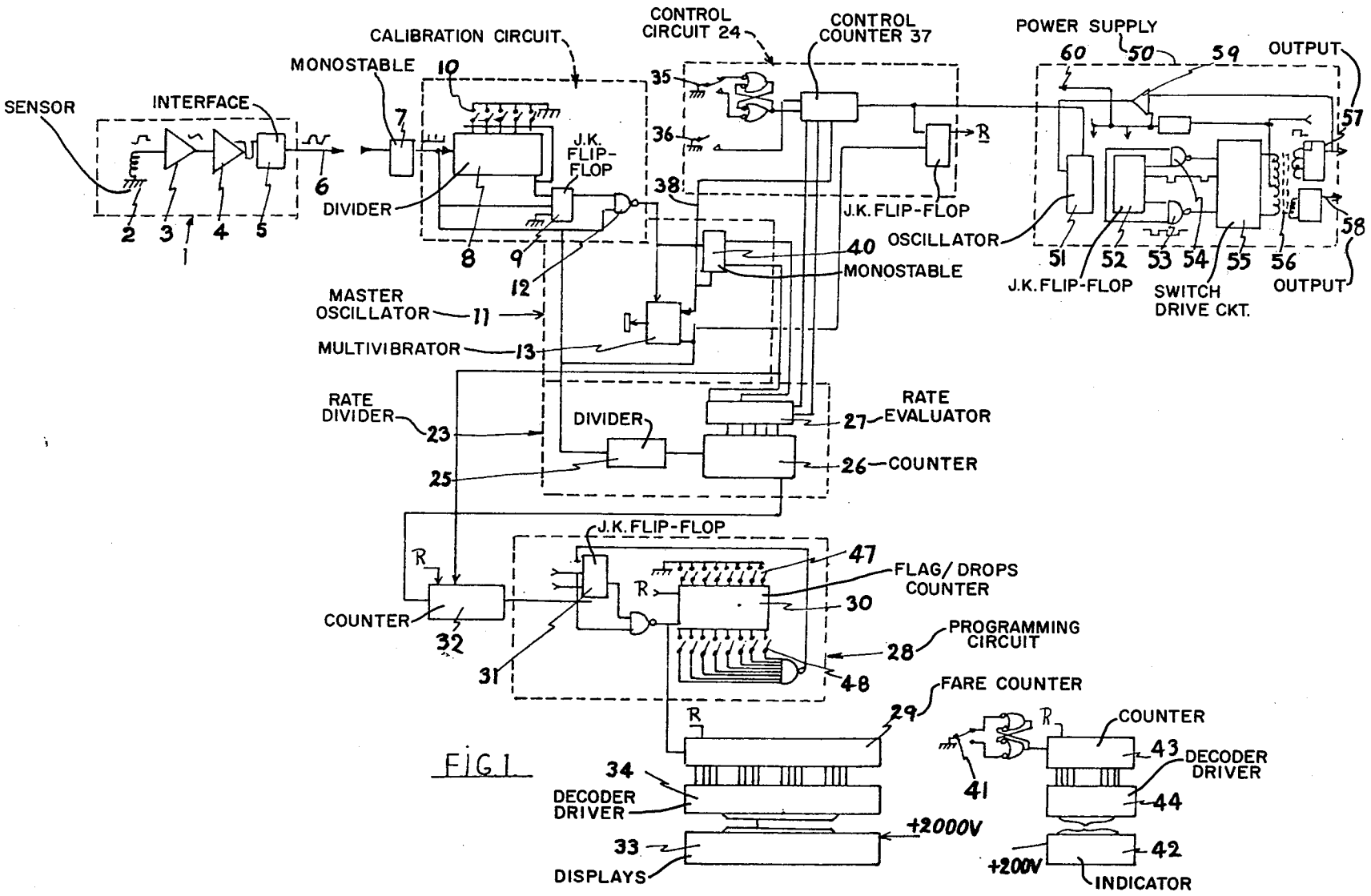
Figure 2:
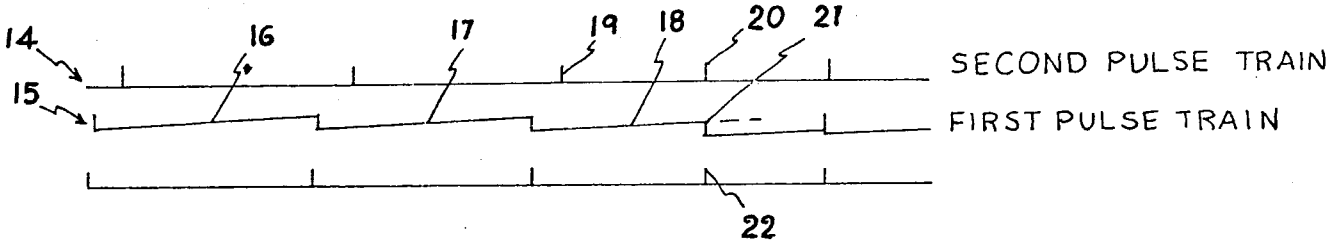

One preferred form of the invention will now be described with reference to the accompanying drawings in which:

FIG. 1 is a general block wiring diagram of a taximeter according to the invention, and FIG. 2 is a graph showing the inter-relationship between the output pulses of the first and second electrical pulse train.

DETAILED DESCRIPTION OF A PREFERRED EMBODIMENT

In the preferred form of the invention a sensor unit 1 is provided consisting of a sensitive pickup coil 2, a very high gain amplifier 3 and a trigger circuit 4. When the pickup coil is in a varying magnetic field, a minute current flows. This current is amplified and integrated over the complete cycle of variation thus reducing the sensitivity to noise and short sharp changes. The amplifier signal is then applied to the trigger circuit where it is converted to clean sharp pulses. These pulses are then applied to the meter. When the sensor unit is located close to a vehicles speedmoter it picks up the rotating magnetic field which is actually generated within the speedo. This produces a distance pulse train having one pulse per revolution of the speedo cable at sensor output 6.

Alternatively the sensor could consist of a transducer (not shown) consisting of a permanent magnet, a reed switch and a slotted vane connected to the drive train of the taxi so that the slotted vane rotates within the magnetic field to open and close the reed switch to create a similar distance pulse train.

The pulse train, having a frequency proportional to the speed of the taxi, is fed into a monostable 7 which triggers on both edges of the input signal thus giving two pulses per revolution and the resulting output fed into a calibration rate divider 8. As the number of pulses per kilometer is dependent on the car type and model this must be normalised to the meter standard and this is done by the calibration divider. A fixed pulse rate, for example 1200 pulses per kilometer is chosen and as the input is arranged to always be greater than 1200 pulses per kilometer the calibration divider will be set per installation to inhibit one pulse in every one of a predetermined number of pulses to give the standard rate of 1200 pulses per kilometer. To this end the calibration circuit is arranged so that one pulse in every X pulses (where X is presetable) is prevented from being applied to the clock generator. This calibration circuit utilises a divide by 64 counter which counts distance pulses from the monostable 7 these pulses are also applied to a J.K. flip flop 9. When the predetermined number of pulses has been accumulated the counter 8 disables the J.K. flip flop for one pulse and resets itself to its initial state. Thus, one pulse will be omitted in every X pulses, where X can be any number from two to 64 settable by way of calibration switches 10. The output from the calibration divider 8 at the rate of e.g. 1200 pulses per kilometer is then fed as a distance trigger pulse into a master oscillator circuit 11 as will be described further later. From the calibration divider the distance pulses are applied to the J.K. flip flop 9 and nand gate 12. The output of gate 12 is used as a trigger input to an oscillator in the form of an astable multivibrator 13, the operation of which will now be discussed. The astable multivibrator 5 has a free running frequency proportional to the waiting time, typically six pulses per second, each of these pulses ensuring that the J.K.F.F. 9 is in the reset state. In this state nand gate 12 will prevent the distance pulses from triggering the astable 13. If however the distance pulses are faster then six pulses per second, then more than one pulse will appear. between two astable pulses. The first will set the J.K.F.F. 9, preparing the gate 12 to pass the next pulse which will trigger the astable, terminating its relaxation period causing a pulse from the astable to conform with the distance pulse. Provided the distance pulse rate does not fall below the astables free running rate, the astables output will continue to conform to the distance pulses. Mode determination and annuciation is provided by monostable 40. The continuing presence of the trigger holds the monostable in the set state representing the distance mode, the absence of trigger pulses allows the monostable to reset, displaying the waiting time mode.

In this manner the output from the astable oscillator provided a first pulse train, the frequency of which is modified or controlled under predetermined conditions by a second pulse train arriving from the calibration divider at the rate of e.g. 1200 pulses per kilometer. The arrangement of the oscillator is such that when the frequency of the second pulse train exceeds a predetermined limit corresponding to a predetermined speed of the taxi the second pulse train will cut of or truncate the pulses of the first pulse train to conform with the frequency of the calibration divider output. If more than one pulse from the second pulse train is present between the oscillator output pulses of the first pulse train then obviously the distance rate must be greater than the waiting time rate. This fact enables the distance pulse train to trigger the master oscillator during its relaxation period as above described. For example, with reference to FIG. 2 showing a second pulse train at 14 and a first pulse train at 15 the master oscillator receives only one pulse from the second pulse train during pulse build-up 16 and 17 of the first pulse train. During pulse build-up 18 however two pulses 19 and 20 are received from the second pulse train so that pulse 20 causes the first pulse train to be triggered at point 21 to give the resulting output pulse 22.

The output of the master oscillator circuit 11 representing the fare in a certain proportion whether in time or distance mode is then fed into a programmable rate divider 23.

In order to provide one pulse to represent a unit increase in the indicated fare, programmable rate divider 23 is used having a division rate dependent upon tariff selection, and mode i.e. time or distance. In the preferred form of the taximeter provision has been made for predetermined tariff rates to be selectable from a control circuit 24. The fare input pulses first pass through a divider 25 whose rate is set to give an optimum resolution for the particular distance per drop, then to a divide by X counter 26 where X is a function of tariff and mode and is preset by wire links. In order to reduce the links required to two per rate, a decimal to BCD converter is used between the rate evaluator 27 and the divider 26. The divider output then is a pulse train, each pulse representing a unit increase in the indicated fare.

The rate evaluator consists of a number of gates arranged to program the divider to the selected tariff and mode as set by the control circuit 24. The unit increase (known as "drop") is different for different areas and may be e.g. 1, 2, 5 or 10 cents. Consequently it is necessary to increase the fare indication by this number of cents for each pulse output from the programmable rate divider.

This is achieved by a flag/drops programming circuit 28 which, when enabled by a pulse from the programmable rate divider produces a number of pulses to a fare counter 29 which is a four stage decade counter which receives 20 $KH_z$ pulses each representing 1 cent. These are accumulated by the counter and the total indicated on the seven segment displays 33. This fare is reset to zero after each fare. A decoder driver 34 is used to drive the seven segment displays in a known manner. The flag/drops programming circuit determines how many pulses (each pulse representing 1 cent increase in the fare charge) will be allowed to be transmitted to the counter 29.

The initial distance covered by the flag-fall is usually a multiple of the drop distance so that the first so many pulses from the programmable rate divider 23 must be prevented from reaching the drop's flip flop 31. This is achieved by enabling the initial distance extension counter 32 when in the distance mode to count the output pulses from the programmable rate divider and when the predetermined number have passed, the output of the counter 32 goes high and locks there gating all subsequent output pulses from the programmable rate divider to the drop flip flop 31. In this manner the fare counter 29 does not register its first drop until after the first say two drop distances. Programmable rate divider pulses which occur during the time mode are unaffected by the initial distance extension counter due to the setting of the counter in the distance mode.

Control of the taximeter is effected by means of two push buttoms 35 and 36 the first 35 of which cycles the control counter 37 through its four possible states, i.e. Rest (for hire(, Tariff 1, Tariff 2 (where applicable), and stopped. The second button 36 has the sole function of re-enabling tariff 1.

The outputs from the control counter 37 go to the various sections of the meter where they define the modes of operations as described previously.

When "stopped" is selected the "clock" pulse train is stopped by increasing the relaxation period of the astable 13 to infinity so that only distance pulses from the calibration divider 8 are metered. This is achieved by way of connection 38 between the control counter 37 and the astable 13.

A third push button 41 may also be provided to allow the operator to clock up "extras". This is displayed on a separate two decade digital indicator 42. Each consecutive push of the extras button increases the count 5*c* to a maximum of 95*c.* The indicator is driven by a 1½ decade B.C.D. counter 43 via a decoder driver 44 and the counter is wired so that each pulse fed into it advances the counter by five.

An alternative to the Extras described above would be an automatic increase in the flag fall when the fare is to include a phone charge. This could be achieved by preventing the first, say twenty five 20 $KH_z$ pulses to the fare counter from reaching the flag/drops counter.

Any suitable power supply may be used but preferably the supply is provided as shown at 50. This is a pulse width controlled switching mode power supply providing both 200 v.d.c. and 5 v.d.c. The power supply includes a 40 $KH_z$ oscillator 51, a J.K. flip flop 52 and two gates 53 and 54 driving the switching drive circuit 55 to the transformer 56. The 5v output is at 57 and the 200v output at 58. Feedback is taken from the 5v line to the pulse width control circuitry by way of comparitor 59 to ensure regulation of the voltage. There is also an auxiliary 5v output at 60 to the control circuit 24.

If desired a master memory display unit (not shown) can be provided. This unit contains a convenient digital display output which can be switched to receive the output of one of several CMOS counters. Alternatively mechanical drum counters could be used. These counters receive information from the meter, for example, total miles, paid miles, total earnings etc., at convenient points in the circuit. It is preferable that this unit contains a nickel cadmium battery to supply the necessary uninterrupted power. A power line is included to charge the nickel cadmium battery from the power supply of the taxi when the meter is running.

The invention also envisages a method of operating a taximeter which method includes the broad step of modifying a clock pulse train by a further train emanating from a transducer which gives a signal for each predetermined measurement of distance run by the taxi.

In an alternative form of the invention the operations described above could be achieved by the programming of a suitable standard computor such as a micro processor to achieve the modification of the first pulse train by the second pulse train in the manner described. The programming could be by way of hard wired links or by the use of a software package or a combination of the two depending on the type of computor used. Additional components, such as a nand gate and other necessary components, could also be wired to the microprocessor to achieve the same effect as the circuitry shown in the accompanying drawings.

The use of the taximeter is also envisaged with taxis having an electronic instrument array, in which case the transducer adapted to form the second electrical pulse train may be integral with and form part of the normal instrumentation of the taxi vehicle.

I claim:

1. A taximeter for calculating a fare total from a predetermined combination of charges based on distance and/or time factors, said taximeter comprising a constant frequency oscillator adapted to emit a first pulse train; and a transducer adapted to emit a second pulse train proportional to the speed of the taxi; means for modifying said first pulse train to conform to the frequency of the said second pulse train when the frequency of said second pulse train exceeds a predetermined limit, said modifying means including a flip flop and a nand gate in circuit with said oscillator, said second electrical pulse train being applied in use to said flip flop, the output of which is connected to said nand gate and hence to said oscillator the output of which is fed back to said flip flop so that in use each pulse issuing from said oscillator fixes said flip flop in the reset state causing said nand gate to prevent said distance pulse train triggering said oscillator until said second pulse train exceeds a predetermined frequency whereupon more than one pulse from said second pulse train appears between two pulses of said first pulse train, the first of said pulses from said second pulse train setting said flip flop to prepare said nand gate to pass the second of said pulses from said second pulse train, which pulse then triggers said oscillator terminating the relaxation period thereof and causing a pulse in said first pulse train to issue from said oscillator conforming with said second pulse from said second pulse train, said taximeter including activation means adapted on operation to activate the taximeter, counting means for counting directly or indirectly the sum of pulses issuing from said time function and display means adapted to display the fare resulting from the sum of pulses counted by said counting means in a convenient form.

2. A taximeter as claimed in claim 1 including a rate divider adapted to delete a predetermined proportion of the output pulses from said oscillator so that each remaining pulse represents a unit increase in the indicated fare, said rate divider being programmable to adapt to varying tariffs.

3. A taximeter as claimed in claim 1 wherein said counting means include provision to provide a number of pulses corresponding to a present hireage or flag-fall fee to said display means and the number of pulses issuing from said counting means relative to the number of pulses from said first pulse train is settable in said counting means.

4. A taximeter as claimed in claim 1 wherein said transducer includes a coil adapted to pick up changes in magnetic field from a part of the taxi rotating proportional to the speed of the taxi, an integrator adapted to smooth the output from said coil and a Schmitt trigger adapted to convert the output from said integrator to distinct pulses.

* * * * *